US005090285A

United States Patent [19]

Kondô

[11] Patent Number: 5,090,285

[45] Date of Patent: Feb. 25, 1992

[54] SHEET CUTTER

[75] Inventor: Takajirô Kondô, Tottori, Japan

[73] Assignees: Hitachi Metals, Ltd., Tokyo; Yasugi Seimitsu Co., Ltd., Shimane, both of Japan

[21] Appl. No.: 284,025

[22] Filed: Dec. 14, 1988

[30] Foreign Application Priority Data

Dec. 14, 1987 [JP] Japan ..... 62-315572
May 11, 1988 [JP] Japan ..... 63-113968
May 13, 1988 [JP] Japan ..... 63-116096

[51] Int. Cl.[5] ..... B26D 1/09

[52] U.S. Cl. ..... 83/636; 83/582; 83/628; 83/694; 83/697

[58] Field of Search ..... 83/582, 583, 341, 342, 83/561, 614, 640, 697, 349, 636, 694

[56] References Cited

U.S. PATENT DOCUMENTS

Re. 26,418 7/1968 Bradley ..... 83/342
635,457 10/1899 Yandall ..... 83/636
959,035 5/1910 Taylor ..... 83/602
2,246,957 6/1941 Shields ..... 83/341
2,408,363 10/1946 Beckman et al. ..... 83/243
3,064,512 11/1962 Zurlo ..... 83/694
3,279,295 10/1966 Teplitz ..... 83/694
3,552,251 1/1971 Neff et al. ..... 83/349
3,956,954 5/1976 Edwards ..... 83/341
4,651,609 3/1987 Dobring et al. ..... 83/628
4,651,610 3/1987 Schwelling ..... 83/697

*Primary Examiner*—Frank T. Yost
*Assistant Examiner*—Scott A. Smith
*Attorney, Agent, or Firm*—Finnegan, Henderson, Farabow, Garrett, and Dunner

[57] ABSTRACT

A sheet cutter comprises a fixed cutting member; a movable cutting member whose cutting edge slopes so that the movable cutting member has a V-shaped extension and/or notch; and a control member for controlling the stroke of the movable cutting member, whereby the movable cutting member is moved to overlap with the fixed cutting member to shear a sheet at a predetermined portion thereof.

1 Claim, 5 Drawing Sheets

SHEET CUTTER

BACKGROUND OF THE INVENTION

The present invention relates to a sheet cutter for cutting or partially cutting a sheet such as straight paper, rolled paper, folded paper and a film, at a desired length or desired portion leaving partially the sheet uncut in a printer, a ticket vending machine, a facsimile machine or the like.

In one of conventional sheet cutters of such kind, a saw-like cutting member is put into a groove as disclosed in the Japanese Utility Model Publication No. 45276/79. Another one of the conventional sheet cutters has scissors-like construction.

In the conventional sheet cutter whose saw-like cutting member is put into the groove, the sharp cutting edge of the member is penetrated into a sheet. The groove only acts to hold the sheet, and no sharp cutting edge is provided at the groove. The sharpness of the cutting edge of the saw-like member is necessary to stably cut the sheet. If the cutting edge is worn due to the use thereof or the chips or dust of the sheet deposits in the troughs between the cutting teeth of the saw-like cutting member, the member is likely to push the sheet into the groove without cutting it.

The usable life of the cutting member is known to be likely to become short at the innermost portions of the troughs, because (1) the tips of the teeth of a grinding stone for sharpening the cutting teeth of the saw-like cutting member come into contact with the member at the innermost portions of the troughs so that the tips are much worn to make it difficult to sharpen the cutting edges of the member at the innermost portions of the troughs, (2) the chips or dust made at the time of the cutting of the sheet is likely to deposit in the innermost portions of the troughs, and (3) the sheet is easily folded into the groove at the cutting by the troughs, at which the sheet is mostly cut, in case that the cutting resistance increases due to the wear of the cutting edges of the cutting member, the deposition of the chips or dust, or the like. In the cutter using the saw-like cutting member, since the usable life of the saw-like cutting member is usually short, the cutter has a disadvantage that the cutting member needs to be often cleaned or replaced.

In the conventional sheet cutter having a scissors-like construction, a sheet is cut between the cutting edges of a pair of cutting members. For that reason, even if the cutting edges are not very sharp or are slightly worn, they can cut the sheet. Besides, the cutting members do not have troughs in which the chips or dust of the sheet is likely to deposit as in those of the saw-like cutting member. As a result, the usable life of the cutting members of the sheet cutter is longer than that of the saw-like cutting member. The difference in the length of the period of usability is also understood from the fact that the cutting edge of a kitchen knife needs to be often sharpened but those of scissors do not need to be often sharpened.

The stroke of the saw-like cutting member of the conventional sheet cutter can be optionally controlled to either cut the sheet or only make a perforation therein, as described in the above-mentioned Publication. However, since the conventional sheet cutter having the scissors-like constitution cuts the sheet in such a manner that the cutting edges of the pair of cutting members are gradually overlapped with each other from one end of each of the cutting edges to the other thereof, it is difficult to leave partially the sheet uncut. Although the pair of cutting members can be stopped halfway to partially cut the sheet to leave a portion thereof uncut, the sheet partially cut in that way is more likely to be torn off than a sheet having a perforation.

SUMMARY OF THE INVENTION

The present invention was made in order to solve the above described disadvantages. Accordingly, it is an object of the present invention to provide a sheet cutter having scissors-like structure which can be used to entirely cut a sheet or to partially cut it to leave a portion of optional location and length uncut to make it possible to tear off the portion manually as occasion demands. Since the sheet cutter cuts the sheet as scissors, the usable life of the cutter is long.

According to a first aspect of the present invention, the sheet cutter is characterized in that the cutter comprises a fixed cutting member and a movable V-shaped cutting member which is made of a plate concavely curved in respect to the fixed cutting member and has a cutting part for locally breaking the sheet. The cutting edge of the movable cutting member is moved to overlap with that of the fixed cutting member while the concavely curved side of the movable cutting member is brought into pressure contact with the cutting edge of the fixed cutting member, so that the sheet inserted between the cutting edges of both the cutting members is sheared. The cutting part for locally breaking the sheet is provided at the center of the movable cutting member so as to make a cut opening so that the cutting member cuts the sheet from the center of the sheet toward both the side edges thereof as scissors do. The cutting part can be shaped as any of a projection, a saw blade, a triangle, a trapezoid and so forth as far as the part can make the cut opening. The concavely curved side of the movable cutting member is brought into pressure contact with the straightly-extending fixed cutting member to overlap therewith to form a cross angle, which is defined as an angle between the fixed cutting member and the movable cutting member when viewing them in the direction perpendicular to the pressure contact direction. The movable cutting member has the V-shaped extension, so that a shearing angle is formed.

In the above sheet cutter, the movable cutting member may be constructed by a base and a V-shaped cutting portion made of a thin plate which has a sharp-edged projection at the center of the portion and is attached to the base so as to be concavely curved in respect to the fixed cutting member.

Further, in the above sheet cutter, the blank of the fixed cutting member may be concavely curved and the movable cutting member may be made of a V-shaped flat plate, so that a cross angle is formed. Because of such constitution, the movable cutting member can be either made monolithic or composed of a base and a cutting portion having a small thickness and attached to the base. The weight of the movable cutting member can thus be reduced if the form thereof is appropriately determined.

In the above sheet cutter, if the cutting edge of the movable cutting member is shaped as a staircase at one or both of the ends thereof and the stroke of the movable cutting member is controlled, the length of the cutting of the sheet can be optionally determined to leave the portion of the sheet uncut at one or both side edges thereof. The uncut portion is easily torn off manually as occasion demands.

Furthermore, in the above sheet cutter, a stopper for determining the position of the cutting edge of the movable cutting member in the direction of the pressure contact may be provided near the center of the cutting edge of the movable cutting member or the central projection thereof. Although a conventional scissors-type sheet cutter for cutting a sheet has a guide member provided at the end of a fixed cutting member so as to smoothly overlap a movable cutting member with the fixed cutting member as the cutting edges of both the cutting members are brought into pressure contact with each other, the sheet cutter provided in accordance with the present invention is not provided with such guide member. For that reason, the stopper is provided near the center of the cutting edge of the movable cutting member or the central projection thereof so that the urging force of a spring, which urges the movable cutting member in the direction of the pressure contact, is controlled to prevent the movable cutting member from colliding against the fixed cutting member.

According to a second aspect of the present invention, the sheet cutter is characterized in that it comprises a movable cutting member made of a thin plate and having a cutting edge shaped in a V-shaped notch, and a fixed cutting member having the cutting edge with which that of the movable cutting member is brought into pressure contact. At least one of the cutting members is convexly curved in respect to the other so as to bring the cutting edge of the movable cutting member into pressure contact with that of the fixed cutting member. If one of the movable and the fixed cutting members is provided with a nick across the cutting edge thereof, the sheet can be partially cut so that a portion thereof is left uncut. If the movable cutting member is provided with lugs located at both the ends of the member and extending in the direction of the cutting movement of the member to guide the cutting edge of the member into pressure contact with that of the fixed cutting member, a gap defined between the movable and the fixed cutting members, into which the sheet is inserted, can be widened.

In the above sheet cutter, one of the cutting edges of a fixed and a movable cutting members is convexly curved in respect to the other in the direction of the pressure contact, so that the cutting edge of the movable cutting member is moved to overlap with that of the fixed cutting member to shear the sheet from both the side edges thereof toward the center thereof as the scissors do. Since the movable cutting member is made of a thin plate, the cutting edge of the member cuts the sheet and thereafter passes through the cut parts of the sheet so that it does not push the sheet. For that reason, if the central portion of the movable cutting member is provided with a nick in the cutting edge thereof, the region of the sheet, which corresponds to the nick, can be left uncut when the other region of the sheet is cut by the sheet cutter. If the movable cutting member is provided with a plurality of nicks across the cutting edge thereof, the sheet can be partially cut to have a perforation-like line. In that case, since the cross angle of the movable and the fixed cutting members is determined by the curves of the cutting members, the angle decreases from the ends of the movable cutting member toward the center thereof at each of the nicks so that the cutting edges of the movable and the fixed cutting members are prevented from catching on each other.

DETAILED DESCRIPTION OF THE PREFERRED EMBODIMENTS

Embodiments of the present invention will be hereafter described with reference to the drawings attached hereto.

Figure 1:
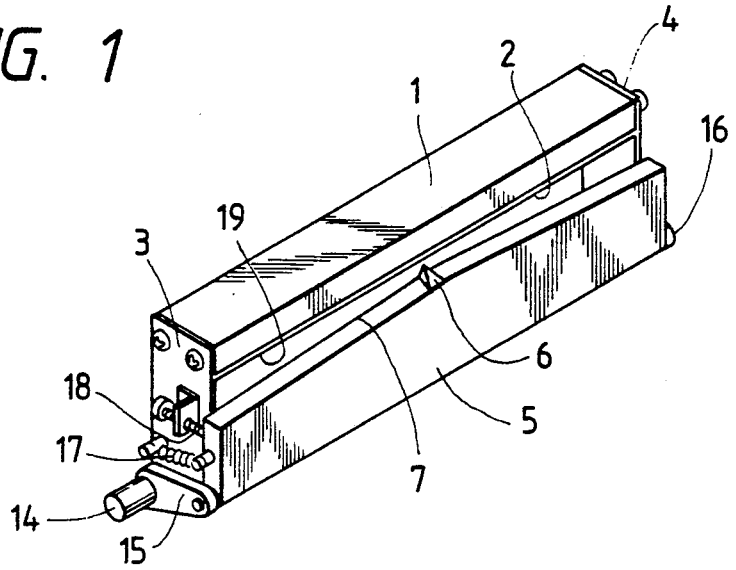
FIG. 1 is a perspective view of a sheet cutter which is a first embodiment of the present invention.

FIG. 1 shows a sheet cutter which is a first embodiment of the present invention. The sheet cutter comprises a fixed cutting member 1 having a straightly-extending cutting edge 2 and secured by side plates 3 and 4 located at both the ends of the member, and a movable cutting member 5 having a cutting portion 7 which has a V-shaped extension having a cutting edge and has a cutting part 6 shaped as a triangle and located at the center of the cutting portion so as to locally break a sheet. The side of the movable cutting member 5, which is brought into pressure contact with the cutting edge 2 of the fixed cutting member 1 to cut the sheet, is concavely curved to attain a cross angle which is formed by movable cutting member and fixed cutting member.

Figure 2:
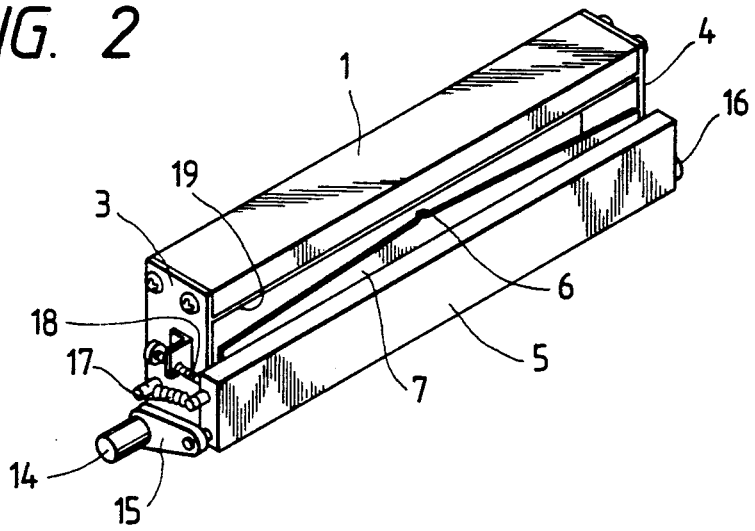
FIG. 2 is a perspective view of a sheet cutter which is a second embodiment of the present invention.
Figure 3:
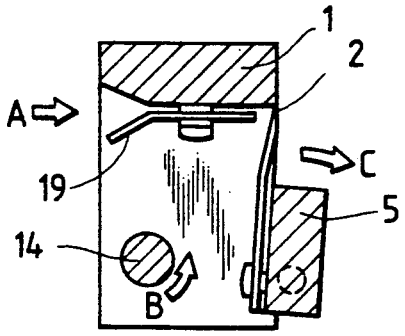
FIG. 3 is a sectional view of the sheet cutter shown in FIG. 2.
Figure 4:
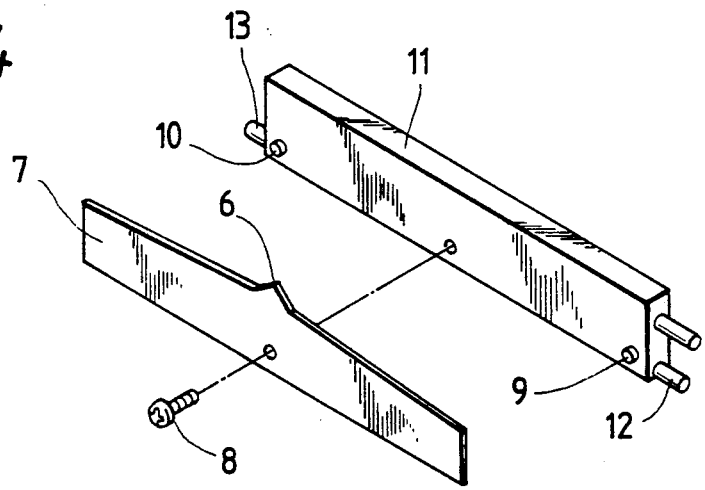
FIG. 4 is a view for explaining the assembly of the sheet cutter shown in FIG. 2.

FIGS. 2, 3 and 4 show a sheet cutter which is a second embodiment. The movable cutting member 5 of the sheet cutter is supported by shafts 12 and 13 provided at both the ends of the member and coupled to arms 15 and 16 secured to both the ends of a drive shaft 14, and is urged by a spring 17 so as to swing toward the fixed cutting member 1 of the sheet cutter to put the cutting edge of the movable cutting member into pressure contact with the fixed cutting member. FIG. 2 illustrates a preferred embodiment of the invention wherein the cutting portion 7 of movable cutting member 5 is thinner than the remaining portion of the movable cutting member. The position of the movable cutting member 5 is adjusted by a screw 18 attached as a stopper to the side plate 3. A sheet guide plate 19 is attached to the bottom of the fixed cutting member 1 to guide a sheet (not shown in the drawings) inserted into the sheet cutter in a direction A shown in FIG. 3.

When the drive shaft 14 is rotated in a direction B shown in FIG. 3, the cutting part 6 of the movable cutting member 5 makes an opening in the central portion of the sheet and the sheet is then cut from the opening toward the right and left side edges of the sheet. Since the side of the cutting portion 7 of the movable cutting member 5, which is brought into pressure contact with the fixed cutting member 1, is concavely curved, the sheet is cut by the cutting portion and the fixed cutting member when the cutting portion and the movable cutting member are overlapped with each other while the cutting portion is slightly swung in a direction C (shown in FIG. 3) about the shafts 12 and 13 as the drive shaft 14 rotates. In the movable cutting member 5 shown in FIGS. 2–4, the cutting portion 7 made of a thin plate and having the cutting part 6, which is a projection at the center of the cutting portion, is attached at the center of the cutting portion by a screw 8 to a base 11 having bosses 9 and 10 at both the ends of the base (FIG. 4). Because of such construction, the side of the movable cutting member 5, which is brought into pressure contact with the cutting edge 2 of the fixed cutting member 1, can be easily concaved.

Figure 5:
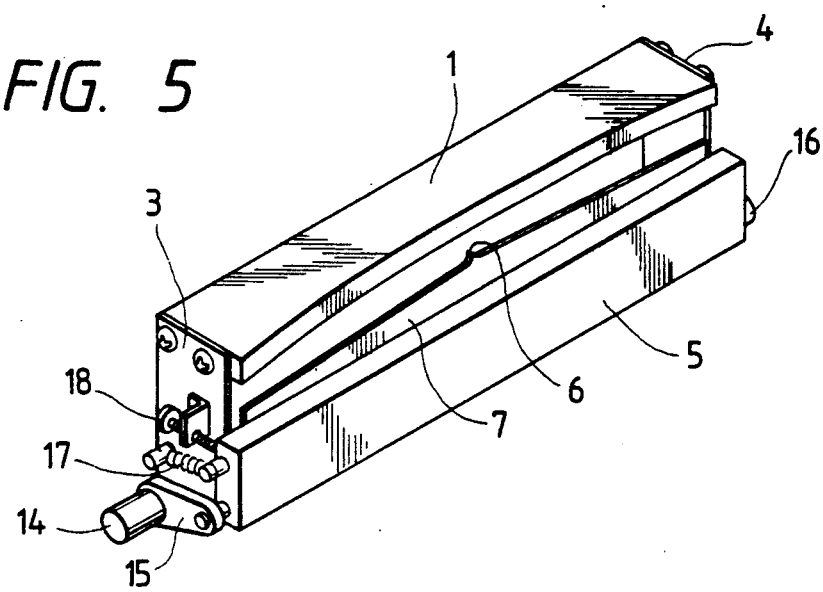
FIG. 5 is a perspective view of a sheet cutter which is a third embodiment of the present invention, FIGS. 6(*a*) and 6(*b*) are front views of examples of the movable cutting member of a sheet cutter.

FIG. 5 shows a sheet cutter which is a third embodiment. Since the flank of the fixed cutting member 1 of the sheet cutter is concavely curved, a cross angle can be formed although the side of the movable cutting member 5 of the sheet cutter, which is brought into pressure contact with the fixed cutting member, is not concavely curved. For that reason, it is easy to manufacture the movable cutting member 5.

Figure 6A:
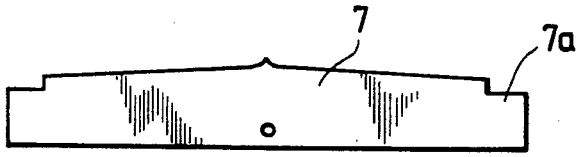
Figure 6B:
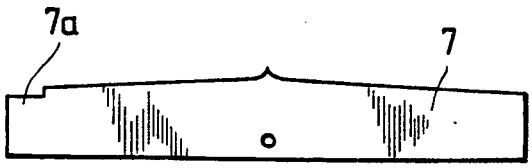

FIGS. 6(*a*) and 6(*b*) show examples of the cutting portion 7 of the movable cutting member of a sheet cutter shown in FIGS. 2 or 5. The cutting portion 7 is nicked in the cutting edge thereof to have a staircase-shaped part 7*a* at one or both ends of the portion and at the center thereof to surely partially cut a sheet even if the stroke of the movable cutting member becomes unstable.

Figure 7:
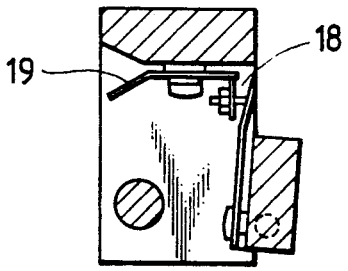
FIG. 7 is a sectional view of a sheet cutter which is a fourth embodiment of the present invention.

FIG. 7 shows a sheet cutter which is a forth embodiments. A stopper 18 for adjusting the position of the movable cutting member of the sheet cutter is attached to a paper guide plate 19 nearly at the center of the cutter so that the stopper is located near the projection of the movable cutting member. As a result, even if the sheet cutter undergoes deformation such as distortion due to an external force, the positional relation between the stopper and the projection of the movable cutting member is unlikely to change, thus enabling the sheet cutter to stably operate despite the deformation.

Figure 8:
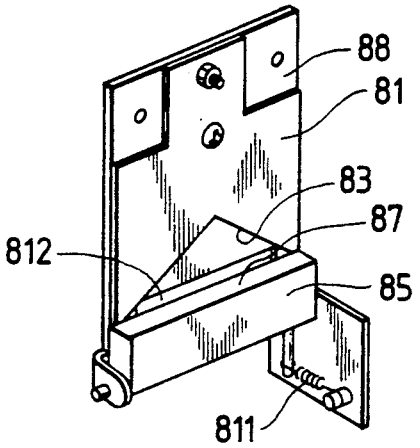
FIG. 8 is a perspective view of a sheet cutter which is a fifth embodiment of the present invention.

FIG. 8 shows a sheet cutter which is a fifth embodiment. The movable cutting member 81 of the sheet cutter is made of a heat-treated carbon tool steel with a thickness of 0.5 mm. A cutting edge 83 slopes so that the movable cutting member has a V-shaped notch. The distance between the ends of the cutting edge 83 is 80 mm. The movable cutting member 81 is attached to a frame 88 so that the member is slidable up and down to cut a sheet (not shown). The fixed cutting member 85 of the sheet cutter is supported in a swingable manner by shafts at both the ends of the member. The cutting edge 87 of the fixed cutting member 85 is put in pressure contact with the movable cutting member 81 by a spring 811 and convexly curved in the face of the movable cutting member so that the central part of the cutting edge protrudes by about 0.25 mm in comparison with both the ends thereof.

When the movable cutting member 81 is moved down, the sheet (not shown) inserted into the passage opening 812 of the frame 88 is cut from both the side edges of the sheet toward the center thereof so that the cutting is completed as the sheet is cut at the center thereof. Since the cutting edge 87 of the fixed cutting member 85 is slightly convexly curved and is put in pressure contact with the cutting edge 83 of the movable cutting member 81, both the cutting edges cut the sheet from both the side edges thereof toward the center thereof in the same manner as scissors.

Figure 9:
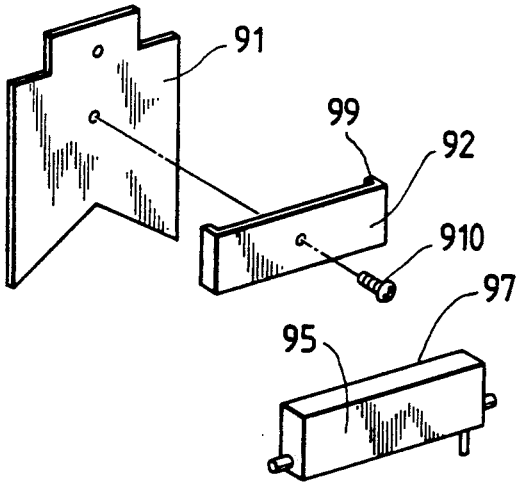
FIG. 9 is a perspective view of a sheet cutter which is a sixth embodiment of the present invention, FIGS. 10(*a*)–10(*d*) are front views of movable cutting members provided in accordance with the fifth or sixth embodiment of the present invention.
Figure 10A:
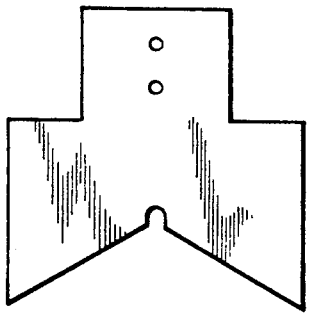
Figure 10B:
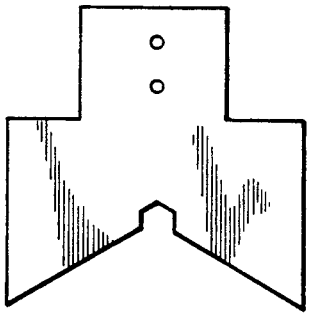
Figure 10C:
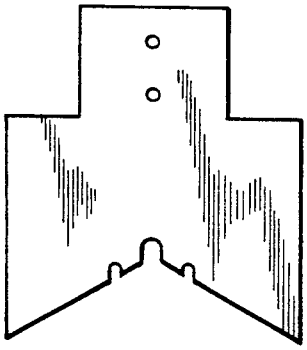
Figure 10D:
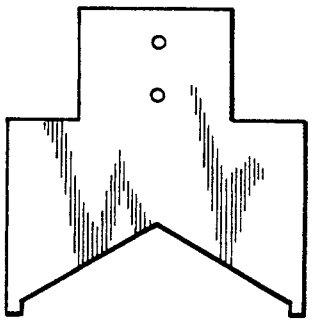

FIG. 9 shows a sheet cutter which is a sixth embodiment. The difference of the sheet cutter from that shown in FIG. 8 is that the movable cutting member 91 of the cutter is convexly curved. The movable cutting member 91 is secured by a screw 910 to the central portion of a base 92 having lugs 99 at both the ends of the base. The rigidity of the movable cutting member 91 is lower than that of the base 93 so that the cutting member is convexly curved in the face of the fixed cutting member 95 of the sheet cutter when the movable cutting member is secured to the base. Since the cutting edge 97 of the fixed cutting member 95 is straight, it is easy to manufacture the member.

FIGS. 10(*a*)–10(*d*) show examples of the movable cutting member of a sheet cutter shown in FIGS. 8 or 9. The example shown in FIG. 10(*a*) is provided with a nick at the center of the cutting edge thereof to partially cut a sheet to leave the central portion thereof uncut. The example shown in FIG. 10(*b*) is provided with a nick at the center of the cutting edge thereof and with another cutting edge along the inner portion of the nick so that a sheet can be entirely cut or partially cut by controlling the stroke of the movable cutting member. The example shown in FIG. 10(*c*) is provided with a nick at the center of the cutting edge of the example and other nicks at the right and left of the former to partially cut a sheet to leave three portions thereof uncut. Since each of the examples shown in FIGS. 10(*a*)–10(*c*) is made of a thin plate, the cutting edge thereof first cuts the sheet at both the side edges thereof and then moves down while the sheet remains at the position of the cutting edge of the fixed cutting member of the sheet cutter. For that reason, the movable cutting member of the sheet cutter does not tear off the sheet at the portion or portions left uncut. If the thickness of each of the examples is more than 1.5 mm, the sheet undergoes an irregular break near the cut line thereof at the time of passage of the example through the sheet, so that when the sheet is ordinary writing paper, the example is very likely to tear off the uncut portion of the sheet. Therefore, it is preferably to set the thickness of each of the examples at 1 mm or less if it is to cut the ordinary writing paper.

The cutting edges of the movable and fixed cutting members of the sheet cutter are convexly curved to each other and the cutting edges are overlapped with each other in the direction of being brought into pressure contact with each other. For that reason, the shorter the distance between the nick of the movable cutting member and the center thereof is, the less likely the cutting edges of the movable and the fixed cutting members are to catch on each other.

The example shown in FIG. 10(*d*) is provided with lugs at both the ends of the example to guide the cutting edges of the movable and fixed cutting members of the sheet cutter. As a result, a gap defined between the movable and the fixed cutting members, into which a sheet is inserted, can be increased.

Figure 11:
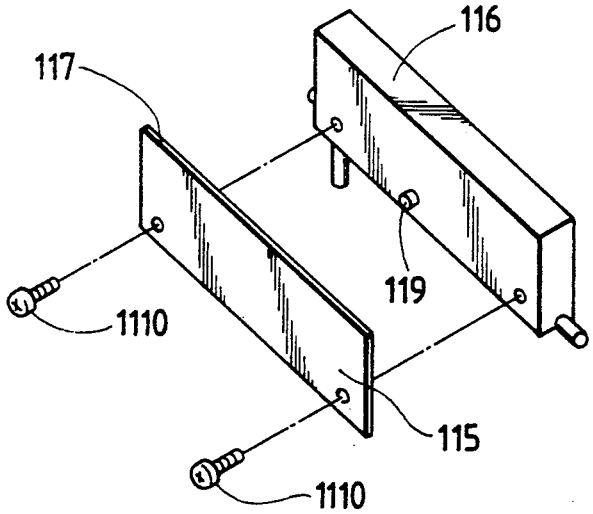
FIG. 11 is a perspective view of the fixed cutting member of a sheet cutter which is a seventh embodiment of the present invention.

FIG. 11 shows a fixed cutting member available for the sheet cutter of a seventh embodiment. Although the fixed cutting member of the sheet cutter shown in FIG. 8 is a monolithic body, the fixed cutting member shown in FIG. 11 is composed of a base 116 and a cutting portion 115. The base 116 has a boss 119 at the center of the base. The cutting portion 115 is secured to the base 119 by screws 1110 at both the ends of the cutting portion so that the portion can be easily convexly curved outward in a desired manner.

Figure 12:
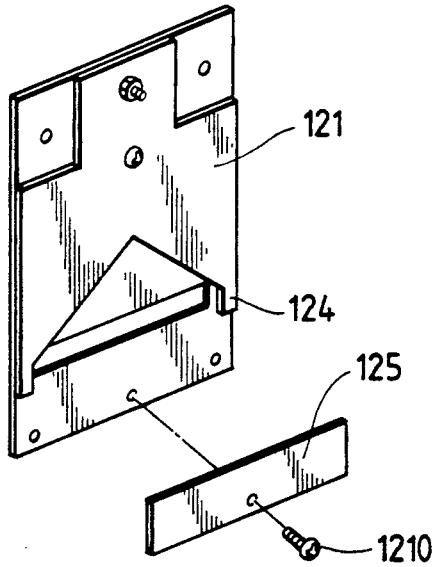
FIG. 12 is a perspective view of the fixed cutting member of a sheet cutter which is a eighth embodiment of the present invention.

FIG. 12 shows a fixed cutting member available for the sheet cutter of eight embodiment. The fixed cutting member 125 made of a thin plate is secured by a screw 1210 at the lower central portion of the member while the member is in pressure contact with the guide portions 124 of the movable cutting member 121 of the sheet cutter at both the ends of the fixed cutting member, so that the cutting member is convexly curved in the direction of pressure contact and a cutting edge of the member is put in pressure contact with that of the movable cutting member 121 by the elasticity of the fixed cutting member 125. For that reason, the constitution of the sheet cutter can be made very simple.

Figure 13:
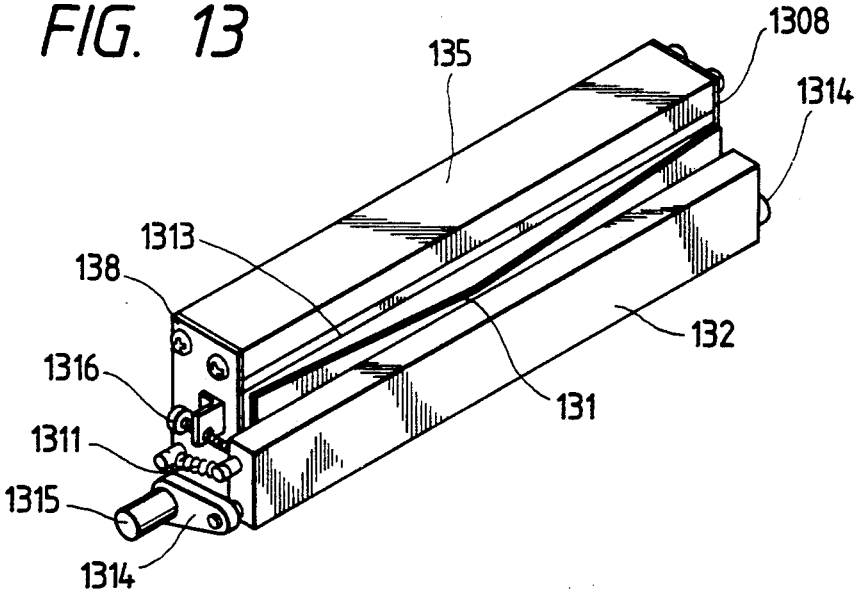
FIG. 13 is a perspective view of a sheet cutter which is a ninth embodiment of the present invention.

FIG. 13 shows a sheet cutter which is a ninth embodiment. In the movable cutting member of the sheet cutter, a cutting portion 131 is attached to a base 132 and coupled to a driver (not shown in the drawing) through arms 1314 and a drive shaft 1315 so that the movable cutting member can be swung. The contact pressure of the movable cutting member to the fixed cutting member 135 of the sheet cutter is adjusted by a spring 1311 and a stopper 1316. A sheet guide plate 1313 is provided in the sheet cutter to surely insert a sheet into it.

Since a sheet cutter provided in accordance with the present invention cuts a sheet as scissors do, the usable life of the cutter is long. Besides, the sheet cutter can also only partially cut the sheet to leave it uncut at one or both side edges thereof or at the center thereof. For that reason, the sheet cutter can be used in the same manner as a conventional sheet cutter having a saw-like cutting member.

It is claimed:

1. A sheet cutter, comprising:

a fixed cutting member having a cutting edge;

a movable cutting member having a V-shaped cutting edge; and a means for controlling the stroke of said movable cutting member, wherein said movable cutting member and the respective cutting edge are movable to overlap with said fixed cutting member and the respective cutting edge to shear a sheet inserted between said cutting edges at a prescribed portion of said sheet, and wherein said cutting edge of said fixed cutting member is straight; and said movable cutting member includes a base and a cutting portion made of a thin plate having a sharp-edge projection at the center of said portion projecting from an otherwise smooth cutting edge and attached to said base so that said portion is elastically concavely curved in respect to said fixed cutting member, and a concavely curved side of said movable cutting member being brought into pressure contact with said cutting edge of said fixed cutting member, wherein said sheet is sheared from a central portion to both ends of said sheet, and wherein said cutting edge of said movable member has a single stairstep shaped notch formed in each end thereof and the stroke of said movable cutting member is controlled so that said sheet is sheared except for a part thereof at said ends.

* * * * *